US005241804A

United States Patent [19]

Tsuruta et al.

[11] Patent Number: 5,241,804

[45] Date of Patent: Sep. 7, 1993

[54] VERTICAL TYPE FORMING, FILLING AND CLOSING MACHINE FOR FLEXIBLE PACKAGE

[75] Inventors: Orihiro Tsuruta; Katsuzi Iizuka, both of Gunma, Japan

[73] Assignee: Orihiro Co., Ltd., Tomioka, Japan

[21] Appl. No.: 881,487

[22] Filed: May 11, 1992

[30] Foreign Application Priority Data

Jun. 11, 1991 [JP] Japan ..... 3-139205
Jun. 11, 1991 [JP] Japan ..... 3-139206
Mar. 6, 1992 [JP] Japan ..... 3-049390

[51] Int. Cl.[5] ..... B65B 3/30; B65B 3/16

[52] U.S. Cl. ..... 53/504; 53/526; 53/551

[58] Field of Search ..... 53/451, 551, 552, 554, 53/555, 284.7, 527, 528, 526, 439, 77, 503, 55, 52, 504; 141/10, 317, 198

[56] References Cited

U.S. PATENT DOCUMENTS

| | | | |
|---|---|---|---|
| 2,831,302 | 4/1958 | Jensen et al. | 53/138.4 |
| 3,269,079 | 8/1966 | Schmied | 53/426 |
| 3,324,621 | 6/1967 | Runge | 53/138.4 |
| 3,380,226 | 4/1968 | Tracy | 53/138.4 |
| 3,589,913 | 6/1971 | Rosenberg | 99/77.1 |
| 3,611,657 | 10/1971 | Inoue et al. | 53/138.4 X |
| 3,719,021 | 3/1973 | Rosenberg | 53/551 |
| 3,795,083 | 3/1974 | Wells | 53/138.4 |
| 3,849,965 | 11/1974 | Dominici | 53/451 |
| 4,085,778 | 4/1978 | Wright | 53/138.4 X |
| 4,133,162 | 1/1979 | Baumstingl | 53/450 |
| 4,809,485 | 3/1989 | Nielsen | 53/551 X |
| 4,939,885 | 7/1990 | Steinke | 53/138.4 |
| 4,958,665 | 9/1990 | Iwano | 53/551 X |
| 4,976,091 | 12/1990 | Salemke et al. | 53/503 X |
| 4,979,353 | 12/1990 | Seppala | 53/451 X |

FOREIGN PATENT DOCUMENTS

| | | |
|---|---|---|
| 416552 | 7/1967 | Australia . |
| 0273507 | 7/1988 | European Pat. Off. . |
| 0296889 | 12/1988 | European Pat. Off. . |
| 0327811 | 8/1989 | European Pat. Off. . |
| 1025532 | 4/1966 | United Kingdom . |
| 1202419 | 8/1970 | United Kingdom . |
| 1253836 | 11/1971 | United Kingdom . |

*Primary Examiner*—James F. Coan
*Attorney, Agent, or Firm*—Oblon, Spivak, McClelland, Maier & Neustadt

[57] ABSTRACT

The present invention provides a vertical type forming, filling and closing machine for filling fluid substance discharged from an injection nozzle to a predetermined height into a bag and packaging the same, which comprises:

upper surface height detecting means for detecting the height of the upper surface of fluid substance filled in the bag;

a cylinder connected to the injection nozzle for moving the injection nozzle upwardly and downwardly; and a controlling apparatus for controlling the cylinder in response to the result of detection of the upper surface height detecting means to move the injection nozzle upwardly or downwardly;

the controlling apparatus controlling the cylinder so that the discharging opening of the injection nozzle is always buried, during filling, to a predetermined level from the upper surface of the fluid substance filled in the bag.

7 Claims, 10 Drawing Sheets

VERTICAL TYPE FORMING, FILLING AND CLOSING MACHINE FOR FLEXIBLE PACKAGE

BACKGROUND OF THE INVENTION

1. Field of the Invention

This invention relates to a vertical type forming, filling and closing machine for filling an object substance in the form of a liquid or paste into a bag and sealing the bag to package the object substance.

2. Description of the Related Art

Various vertical type forming, filling and closing machines for a flexible package are already known. A filling section of an exemplary conventional vertical type forming, filling and closing machines for a flexible package is shown in FIGS. 1 and 2*a* which are side and front elevational views, respectively, of such a filling section and also in FIG. 2*b* which is a sectional view taken along line A—A of FIG. 2*a*.

Referring to FIGS. 1, 2*a* and 2*b*, the filling section of the conventional vertical type forming, filling and closing machine for a flexible package is constructed to fill object substance A injected from injection nozzle 902 into a flexible bag and to close the flexible bag.

Injection nozzle 902 for injecting object substance A therethrough is fitted in injection pipe 911, and bag forming guide 913 for forming sheet film 925 into a tubular shape is mounted on the outer periphery at the substantially mid portion of injection pipe 911. Tubular film 901 formed into a tubular shape by bag forming guide 913 is then heat sealed along contacting surfaces along the opposite edges thereof by vertical sealing section 922 provided below bag forming guide 913.

A pair of film feeding rollers $\mathbf{923}_1$ and $\mathbf{923}_2$ each composed of two disk-shaped rollers disposed such that tubular film 901 is held between the four rollers, a pair of cylindrical stripping rollers $\mathbf{924}_1$ and $\mathbf{924}_2$ for stripping the object substance A injected into tubular film 901 and a pair of horizontal sealing blades $\mathbf{920}_1$ and $\mathbf{920}_2$ for sealing the empty filling portion of tubular film 901 obtained by stripping rollers $\mathbf{924}_1$ and $\mathbf{924}_2$ are provided in an individually opposing relationship to each other on the opposite sides of tubular film 901 below injection pipe 911. Stripping rollers $\mathbf{924}_1$ and $\mathbf{924}_2$ are constructed for individual movement in a direction perpendicular to the direction of movement of tubular film 901, that is, in a leftward and rightward direction in FIG. 1, in order to move down tubular film 901, into which object substance A has been injected.

Cutting blade 921 for cutting the empty filling portion of tubular film 901 is provided substantially at the mid portion of horizontal blade $\mathbf{920}_1$. Guide stretching member 926 having two pins extending outwardly downward is mounted at the lower end of injection pipe 911.

In the conventional vertical type forming, filling and closing machine for a flexible package having the construction described above, sheet film 925 is shaped into tubular film 901 by bag forming guide 913 and vertical sealing section 922, and as a motor (not shown) for driving the film feeding rollers $\mathbf{923}_1$ and $\mathbf{923}_2$ rotates, tubular film 901 is drawn out downwardly while it is put into an open condition by guide stretching member 926. Object substance A is injected when stripping rollers $\mathbf{924}_1$ and $\mathbf{924}_2$ and horizontal sealing blades $\mathbf{920}_1$ and $\mathbf{920}_2$ are held spaced away from each other after rotation of film feeding rollers $\mathbf{923}_1$ and $\mathbf{923}_2$ is stopped. After completion of this injection, striping rollers $\mathbf{924}_1$ and $\mathbf{924}_2$ are moved toward each other to hold tubular film 901 therebetween and then rotated in the directions indicated by each of the arrow marks in FIG. 1 together with film feeding rollers $\mathbf{923}_1$ and $\mathbf{923}_2$. As a result of this rotation of stripping rollers $\mathbf{924}_1$ and $\mathbf{924}_2$, tubular film 902 is drawn down, and the empty filling portion of tubular film 901 is formed by stripping rollers $\mathbf{924}_1$ and $\mathbf{924}_2$. When tubular film 901 is drawn down to the position shown in FIGS. 1 and 2*a* by rotation of rollers $\mathbf{923}_1$, $\mathbf{923}_2$, $\mathbf{924}_1$ and $\mathbf{924}_2$, horizontal sealing blades $\mathbf{920}_1$ and $\mathbf{920}_2$ are advanced toward each other to a position at which they hold the tubular film 901 therebetween and perform sealing of tubular film 902, after which tubular film 902 is cut by cutting blade 921. Thereafter, stripping rollers $\mathbf{924}_1$ and $\mathbf{924}_2$ and horizontal sealing blades $\mathbf{920}_1$ and $\mathbf{920}_2$ are spaced away from each other to allow the sequence of operations described above to be repeated.

Conventionally, injection of a fixed amount of an object substance into a bag is realized by injection of such object substance to a predetermined height from the bottom of the bag.

In the conventional vertical type forming, filling and closing machine described above, since the object substance is injected into a bag through an object substance injection nozzle provided at a predetermined height from the bottom of the bag, air is often contained in the bag. Consequently, the amount of the object substance injected into the bag to a predetermined height from the bottom of the bag may not be fixed. Accordingly, significant errors in the packaging amount may be a problem.

Further, while a fixed amount of the object substance to be injected into a tubular film is achieved, in the conventional vertical type forming, filling and closing machine for a flexible package described above, by limiting injection of the object substance to a predetermined height, the object substance injected into the tubular film will spread along the inner wall of the tubular film and the weight of the thus spread object substance will be applied to the inner wall of the tubular film to cause some deformation of the tubular film. In case this deformation occurs on the tubular film, even if the height of the object substance to be packed into the tubular film is limited to a predetermined height, the packaging amount will not be fixed. Accordingly, the amount of object substance to be packaged will not be fixed, and significant errors in the packaging amount may be a problem.

While it seems a possible solution to inject the object substance by a predetermined amount in every injecting operation in order to cope with the problems described above, the solution still has a problem in that, when this construction is employed, if air is contained in the bag, the volume of the bag increases so as to cause deformation of the bag, and accordingly, bags thus produced will not be standard in shape.

SUMMARY OF THE INVENTION

It is an object of the present invention to provide a vertical type forming, filling and closing machine for a flexible package by which the amount of the object substance packaged is fixed to minimize the packaging error amount and to realize the same packaged shape.

In order to attain the object, according to one aspect of the present invention, there is provided a vertical type forming, filling and closing machine for a flexible package for filling a fluid substance discharged from an injection nozzle to a predetermined height into a bag and packaging the same, which comprises:

upper surface height detecting means for detecting the height of the upper surface of the fluid substance filled in the bag;

a cylinder connected to the injection nozzle for moving the injection nozzle upwardly and downwardly; and a controlling apparatus for controlling the cylinder in response to the result of detection of the upper surface height detecting means to operate to move the injection nozzle upwardly or downwardly;

the controlling apparatus controlling the cylinder such that the discharging opening of the injection nozzle is always buried, during filling, to a predetermined level from the upper surface of the fluid substance filled in the bag.

According to another aspect of the present invention, there is provided a vertical type forming, filling and closing machine for a flexible package wherein a fluid substance is filled to a predetermined height in a bag to make the amount of the fluid substance filled in the bag fixed, which comprises a shaping plate which holds, during filling of the fluid substance into the bag, the body portion of the bag to prevent deformation of the bag.

In this instance, a shutter plate may be provided alternatively or additionally which holds, during filling of the fluid substance into the bag, the bottom portion of the bag to prevent deformation of the bag.

The shaping plate and/or the shutter plate may individually be constructed for movement in the direction in which the bag is formed.

Further, the shaping plate and/or the shutter plate may be combined with the construction wherein the discharging opening of the injection nozzle is always buried, during filling, to a predetermined level from the upper surface of the fluid substance filled in the bag.

Since the discharging opening of the injection nozzle is always buried, during filling, to the predetermined level from the upper surface of the fluid substance filled in the bag, no air will be contained in the bag at all.

Further, where the vertical type forming, filling and closing machine for a flexible package comprises the shaping plate and/or the shutter plate, the bag is held by the shaping plate and/or the shutter plate so that otherwise possible deformation of the bag is prevented, and accordingly, errors in the packaged amount when the bag is filled to the predetermined height with liquid substance are minimized.

The above and other objects, features and advantages of the present invention will become apparent from the following description and the appended claims, taken in conjunction with the accompanying drawings in which like parts or elements are denoted by reference characters.

DETAILED DESCRIPTION OF THE PREFERRED EMBODIMENTS

Figure 3:
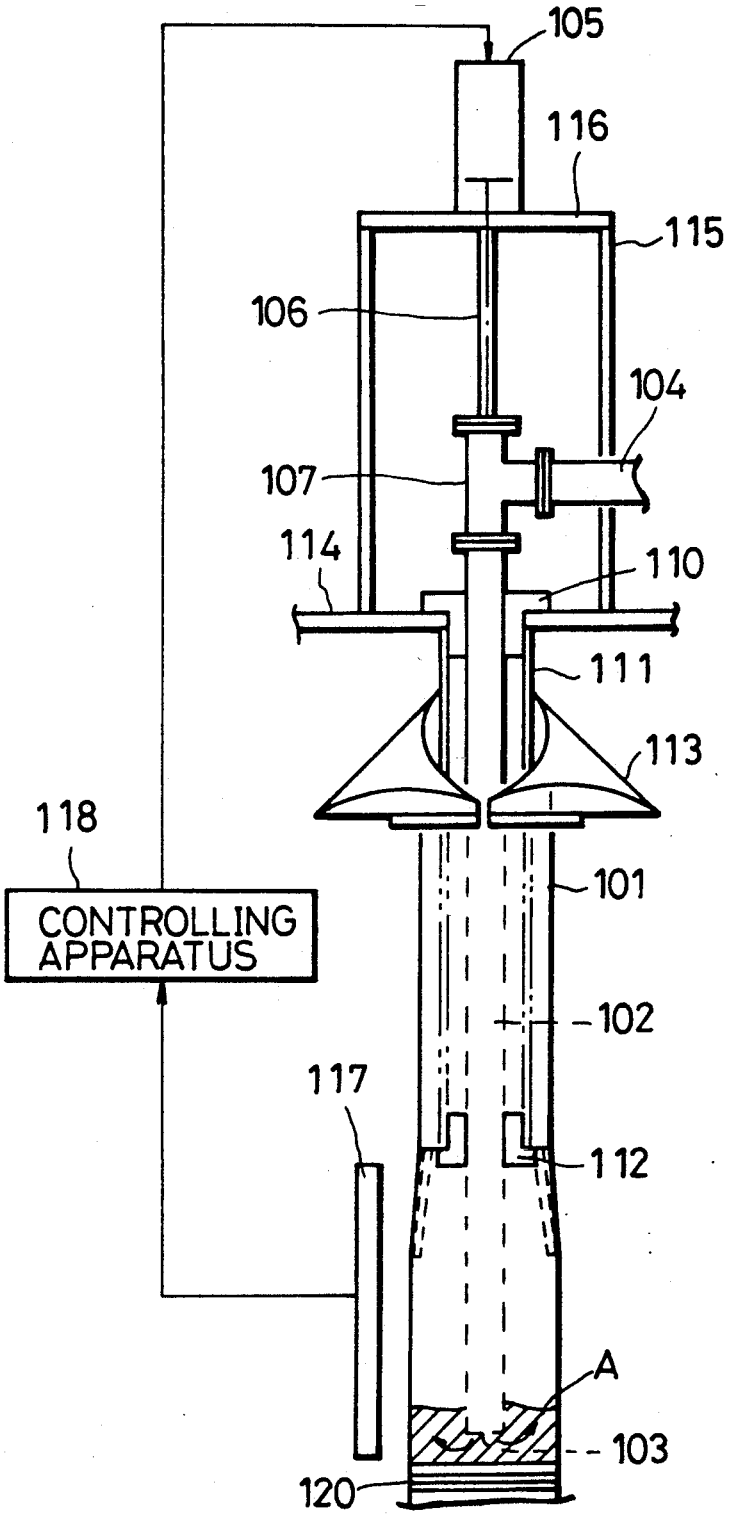
FIG. 3 is a front elevational view, partly in section, showing a filling section of a vertical type forming, filling and closing machine for a flexible package according to a first preferred embodiment of the present invention.
Figure 4:
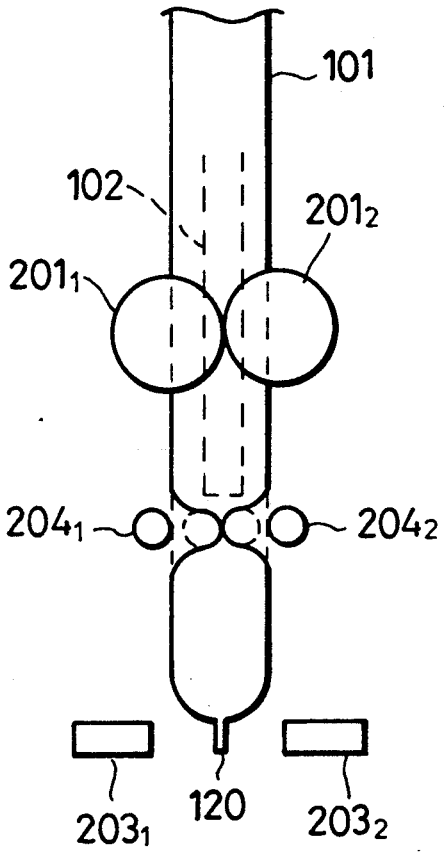
FIG. 4 is a front elevational view of a stripping section of the vertical type forming, filling and closing machine for a flexible package of FIG. 3.

Referring to FIGS. 3 and 4, there is shown a vertical type forming, filling and closing machine for a flexible package according to a first preferred embodiment of the present invention.

The vertical type forming, filling and closing machine for a flexible package of the present embodiment is constructed such that object substance A for packaging injected from injection discharging opening 103 of injection nozzle 102 is filled into tubular film 101 shaped into a tubular shape by bag forming guide 113.

Cylinder stand 115 is provided on the upper face of base 114 while injection pipe 111 is provided on the lower face of base 114. Injection pipe 111 is fitted in bag forming guide 113 and also in the inside of tubular film 101 formed into a tubular shape by bag forming guide 113, and injection nozzle 102 is supported for sliding movement in upward and downward directions by upper guide 110 and lower guide 112 provided at the upper and lower end portions of injection pipe 111.

Rod 106 and T-shaped joint 107 are disposed in the inside of cylinder stand 115 provided on base 114. One end of T-shaped joint 107 is connected by way of rod 106 to cylinder 105 provided on cylinder base 116 which is in turn provided on cylinder stand 115, and the other open end of T-shaped joint 107 positioned on a line of the length of rod 106 is connected to injection nozzle 102. Consequently, injection nozzle 102 moves upwardly and downwardly by cylinder 105. An open end formed on a peripheral wall between the two ends of T-shaped joint 107 is used as injection opening 104 and connected by way of a hose (not shown) to a pump (not shown) provided for pressure feeding object substance A for packaging so that object substance A for packaging may be discharged from injection discharging opening 103.

A pair of film feeding rollers $\mathbf{201}_1$ and $\mathbf{201}_2$ and a pair of stripping rollers $\mathbf{204}_1$ and $\mathbf{204}_2$ are disposed in a spaced relationship above and below injection discharging opening 103 of injection nozzle 102, respectively, as shown in FIG. 4. Each of film feeding rollers $\mathbf{201}_1$ and $201_2$ is composed of two rollers so disposed that tubular film 101 may be held between them. A pair of horizontal sealing blades $203_1$ and $203_2$ are disposed in a similar arrangement below stripping rollers $204_1$ and $204_2$.

Stripping rollers $204_1$ and $204_2$ and horizontal sealing blades $203_1$ and $203_2$ are individually disposed in a symmetrical relationship to each other with respect to the longitudinal direction of tubular film 101, that is, in the injecting direction of object substance A for packaging and are mounted for lateral movement in a direction perpendicular to the longitudinal direction.

Figure 1:
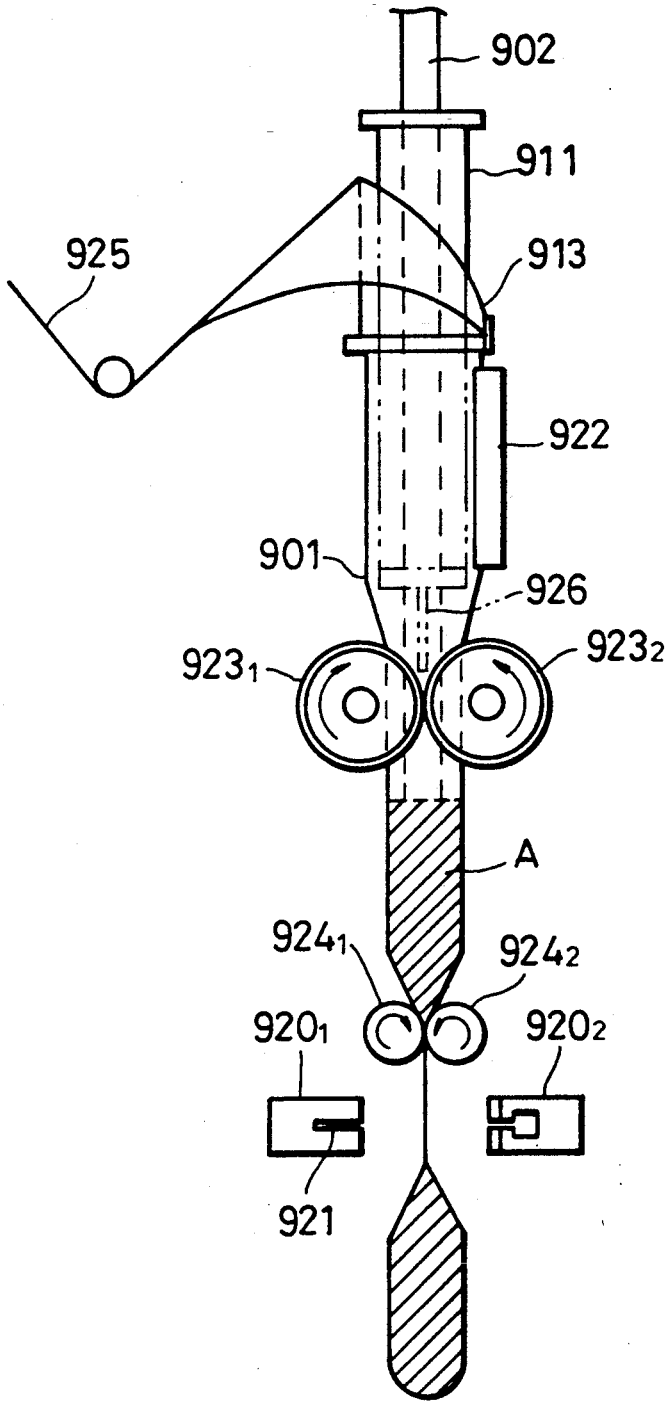
FIG. 1 PRIOR ART
FIG. 1 is a side elevational view showing a conventional vertical type forming, filling and closing machine for a flexible package.
Figure 2A:
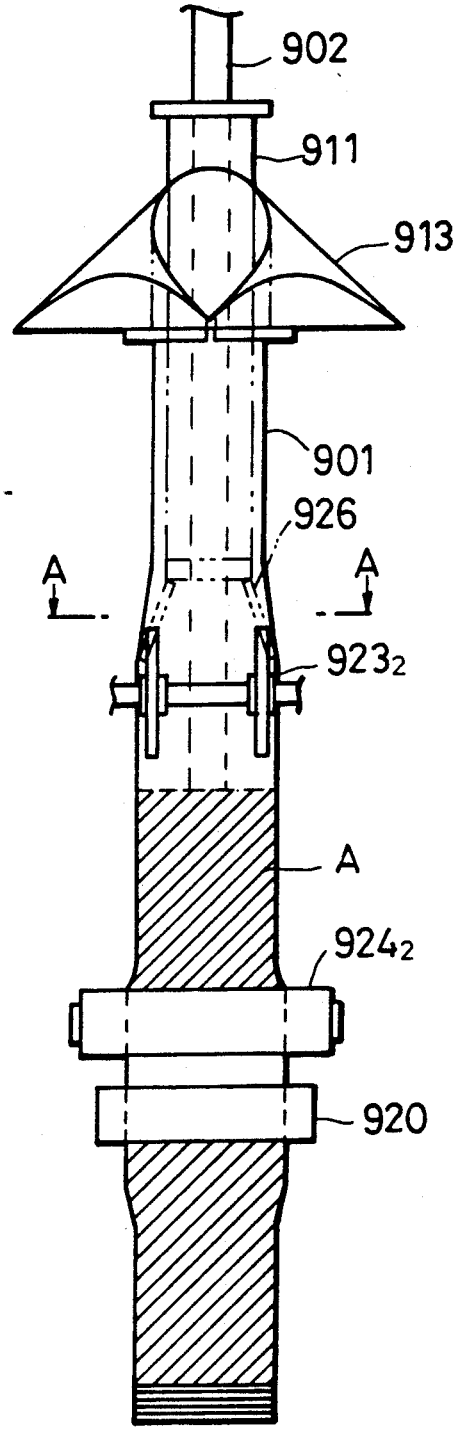
FIG.2a PRIOR ART
FIG. 2*a* is an enlarged front elevational view showing details of a conventional vertical type forming, filling and closing machine for a flexible package.
Figure 2B:
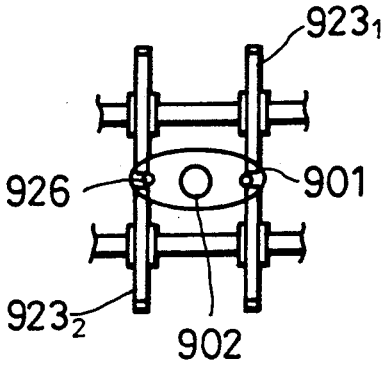
FIG.2b PRIOR ART
FIG. 2*b* is a sectional view taken along line A—A of FIG. 2*a;*

Film feeding rollers $201_1$ and $201_2$ and stripping rollers $204_1$ and $204_2$ are so constructed that the former are each composed of two disk-shaped rollers in combination, while the latter are each composed of a cylindrical roller similar to the conventional vertical type forming, filling and closing machine for a flexible package shown in FIGS. 1, 2*a* and 2*b*.

Object substance injection nozzle 102 is so provided that injection discharging opening 103 is inserted into the tubular film 101 from between film feeding rollers $201_1$ and $201_2$. Further, a cutting blade (not shown) similar to that of the conventional vertical type forming, filling and closing machine for a flexible package is provided for horizontal sealing blade $203_1$.

Furthermore, detecting sensor array 117 such as a photoelectric detecting sensor or a proximity sensor is provided as upper surface height detecting means for detecting the height of injected object substance A for packaging to adjust the injecting condition thereof.

Operation of the components described above are controlled by controlling apparatus 118. Controlling apparatus 118 detects the feeding amount of tubular film 101, the filled amount of object substance and other information/data by means of detecting sensor array 117 provided at the filling part of the machine and controls, from these detected amounts, various operations of the machine such as the upward or downward movement of injection nozzle 102 by cylinder 105 and sealing operation of horizontal sealing blades $203_1$ and $203_2$. The filling process of the vertical type forming, filling and closing machine for a flexible package of the present embodiment will be described below.

(1) Tubular film 101 is center sealed at a vertical sealing section (not shown) provided at the exit location of bag forming guide 113 and is fed downwardly by film feeding rollers $201_1$ and $201_2$ to the position at which the filling operation is to be performed. The controlling apparatus 118 causes, when tubular film 101 comes to a predetermined position, a lateral sealing operation and a cutting operation for tubular film 101 to be performed by horizontal sealing blades $203_1$ and $203_2$. By this horizontal sealing of tubular film 101, sealed portion 120 which makes the bottom of a bag is formed.

(2) After completion of this horizontal sealing, injection nozzle 102 is moved downwardly by cylinder 105 so that injection discharging opening 103 thereof may be positioned in contact with sealed portion 120 which is the bottom of tubular film 101, and after completion of this downward movement, injection of object substance A for packaging by injection nozzle 102 is started. Upon this injection of object substance A for packaging, the controlling apparatus 118 monitors the height of the upper surface of object substance A injected into tubular film 101 and moves, as injection of object substance A proceeds, injection nozzle 102 upwardly by means of cylinder 105 so that injection discharging opening 103 of injection nozzle 102 may always be buried to a predetermined level from the upper surface of injected object substance A for packaging as seen in FIG. 3.

(3) Thereafter, when the position of the upper surface of injected object substance A for packaging comes to a predetermined object substance level which indicates that object substance A has been injected by a predetermined amount into tubular film 101, stripping rollers $204_1$ and $204_2$ are moved toward the center of tubular film 101 to separate object substance A for packaging filled in tubular film 101 at the location to form an empty filling portion.

(4) Then, tubular film 101 is fed by film feeding rollers $201_1$ and $201_2$ to the position at which horizontal sealing blades $203_1$ and $203_2$ are located, and a horizontal sealing and cutting operation for tubular film 101 are performed at the empty filling portion of tubular film 101 at which object substance A is separated.

Subsequently, the steps described above are repeated successively to package the predetermined amount of object substance A for packaging.

With the vertical type forming, filling and closing machine for a flexible package of the embodiment described above, since injection nozzle 102 is moved, in the filling operation for object substance A for packaging, upwardly so that injection discharging opening 103 thereof may always be buried to the predetermined level from the upper surface of injected object substance A for packaging, object substance A for packaging can be filled uniformly into tubular film 101 without allowing air to be contained in tubular film 101. Thus, errors in the packaged amount of the object substance for packaging actually found with a tubular film filled by a vertical type forming, filling and closing machine for a flexible package produced in accordance with the present embodiment were within 1% of a preset value.

It is to be noted that, while the vertical type forming, filling and closing machine for a flexible package of the present embodiment is described to be so constructed that a detecting sensor is provided as upper surface height detecting means for detecting the height of the upper surface of injected object substance A in order that injection discharging opening 103 of injection nozzle 102 may always be buried to the predetermined level from the upper surface of injected object substance A for packaging, alternatively injection nozzle 102 may be moved in accordance with the filling condition of object substance A which is calculated from the discharging speed of object substance A for packaging discharged from injection discharging opening 103 and the capacity of tubular film 101.

Figure 5:
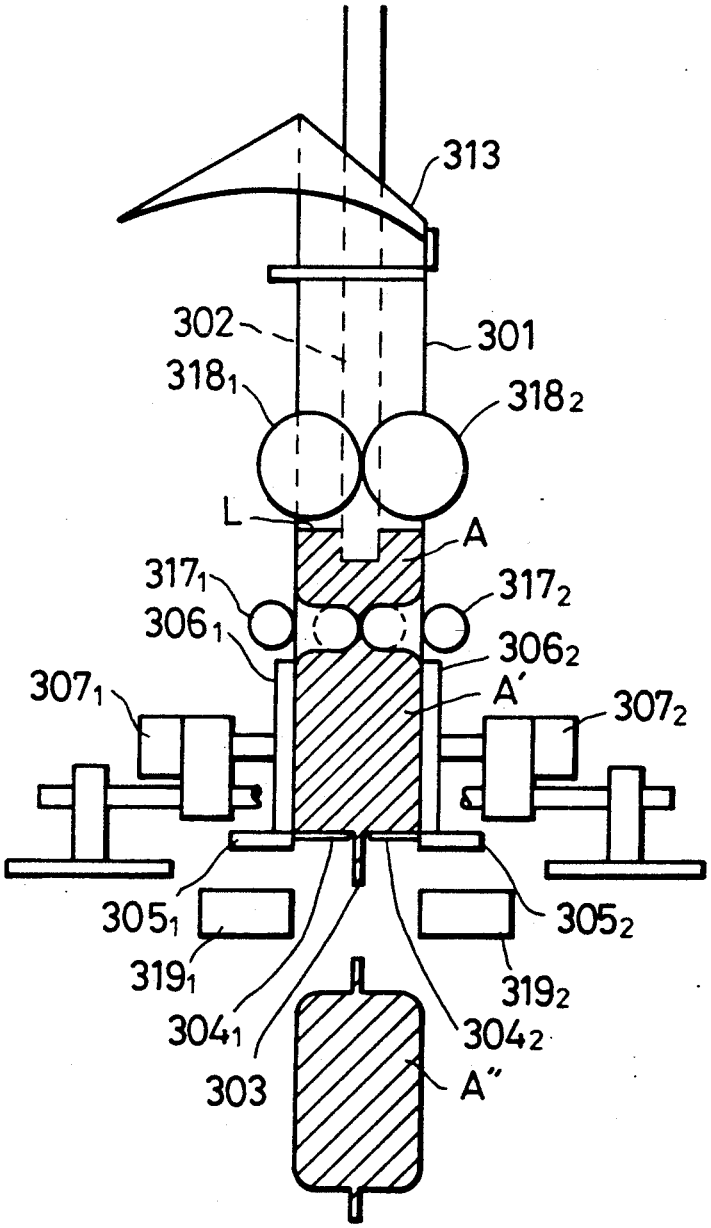
FIG. 5 is a side elevational view, partly in section, showing part of a vertical type forming, filling and closing machine for a flexible package according to a second preferred embodiment of the present invention.

Referring now to FIG. 5, there is shown in side elevation a vertical type forming, filling and closing machine for a flexible package according to a second preferred embodiment of the present invention. The vertical type forming, filling and closing machine for a flexible package of the present embodiment is generally so constructed that object substance A for packaging injected from injection nozzle 302 is packaged into tubular film 301 shaped into a tubular shape by bag forming guide 313.

A pair of film feeding rollers $318_1$ and $318_2$ each composed of two rollers so disposed in a spaced relationship that tubular film 301 may be held between the four rollers and another pair of stripping rollers $317_1$ and $317_2$ each composed of a cylindrical roller are provided below bag forming guide 313 similar to the vertical type forming, filling and closing machine for a flexible package of the preceding embodiment. Disposed below stripping rollers $317_1$ and $317_2$ are a pair of shaping plates $306_1$ and $306_2$ which are driven by a pair of cylinders $307_1$ and $307_2$ connected thereto, respectively, a pair of shutter plates $304_1$ and $304_2$ which are provided in a juxtaposed relationship to shaping plates $306_1$ and $306_2$, respectively, a pair of shutter plate receivers $305_1$ and $305_2$ which hold shutter plates $304_1$ and $304_2$ thereon, respectively, and a pair of horizontal sealing blades $319_1$ and $319_2$. Stripping rollers $317_1$ and $317_2$, cylinders $307_1$ and $307_2$ (shaping plates $306_1$ and $306_2$, shutter plates $304_1$ and $304_2$ and shutter plate receivers $305_1$ and $305_2$) and horizontal sealing blades $319_1$ and $319_2$ are disposed in an individually symmetrical relationship with respect to the longitudinal direction of tubular film 301, that is, in the injecting direction of the object substance and are mounted for movement in a direction perpendicular to the longitudinal direction that tubular film 301 may be held between the elements in each pair.

Object substance injection nozzle 302 is so provided that an end thereof may be inserted into tubular film 301 from between film feeding rollers $318_1$ and $318_2$. Further, a cutting blade (not shown) as in the vertical type forming, filling and closing machine for a flexible package of the preceding embodiment is provided on horizontal sealing blade $319_1$. Each of shaping plates $306_1$ and $306_2$ has a flat plate portion and is so disposed that the plane of the flat plate portion thereof may extend substantially parallel to the longitudinal direction of tubular film 301 and also to the longitudinal direction of horizontal seals to be formed by horizontal sealing blades $319_1$ and $319_2$. Further, shutter plates $304_1$ and $304_2$ are each in the form of a flat plate and are so disposed that flat plate portions thereof may extend perpendicular to the longitudinal direction of tubular film 301.

In addition, in order to detect the injected condition of the object substance, a detecting sensor (not shown) such as a photoelectric sensor or a proximity sensor is provided at object substance level L of a predetermined height.

Operation of the components described above are controlled by a controlling apparatus (not shown). The controlling apparatus detects the feeding amount of tubular film 301, the filled amount of the object substance and other information/data by means of a plurality of sensors provided at various locations and controls, from those detected amounts, various operations of the machine. The filling operation of the vertical type forming, filling and closing machine for a flexible package of the present embodiment will be described below.

(1) Tubular film 301 is center sealed at a vertical sealing section (not shown) provided at the exit location of bag forming guide 313 and is fed downwardly by film feeding rollers $318_1$ and $318_2$ to the lower filling position at which object substance A is to be filled. In this initial condition, shaping plates $306_1$ and $306_2$, shutter plates $304_1$ and $304_2$ and horizontal sealing blades $319_1$ and $319_2$ are individually held spaced from each other in the leftward and rightward direction. The controlling apparatus thus causes, when tubular film 301 comes to a predetermined position, a horizontal sealing and cutting for tubular film 301 to be performed by horizontal sealing blades $203_1$ and $203_2$. By this horizontal sealing of tubular film 301, the bottom portion of the bag is formed.

(2) After completion of this horizontal sealing, shaping plates $306_1$ and $306_2$ and shutter plates $304_1$ and $304_2$ are moved toward the center of tubular film 301 by cylinders $307_1$ and $307_2$, respectively, so that shaping plates $306_1$ and $306_2$ come to a position at which they hold the body portion of tubular film 301 therebetween during filling and shutter plates $304_1$ and $304_2$ hold the bottom portion of tubular film 301 from below. Then, injection of object substance A by object substance injection nozzle 302 is started. During this injection, since tubular film 301 is restricted in the horizontal direction by shaping plates $306_1$ and $306_2$ and restricted at the bottom thereof by shutter plates $304_1$ and $304_2$, tubular film 301 will not be deformed by the weight of injected object substance A.

(3) Thereafter, when the position of the upper surface of injected object substance A comes to predetermined object substance level L which indicates that object substance A has been injected by a predetermined amount into tubular film 301, stripping rollers $317_1$ and $317_2$ are moved toward the center of tubular film 301 to separate object substance A filled in tubular film 101 at the location to form an empty filling portion.

(4) Then, cylinders $307_1$ and $307_2$ are driven to move shaping plates $306_1$ and $306_2$ and shutter plates $304_1$ and $304_2$, respectively, away from each other to their respective original positions and then, tubular film 301 is fed by film feeding rollers $318_1$ and $318_2$ to the position at which horizontal sealing blades $319_1$ and $319_2$ are located. Subsequently, a horizontal sealing and cutting operation of tubular film 301 are performed at the empty filling portion of tubular film 301 at which object substance A' is separated.

Thereafter, the steps described above are repeated successively to package the predetermined amount of object substance A" for packaging.

In the vertical type forming, filling and closing machine for a flexible package of the present embodiment described above, while the amount of the object substance to be packaged is determined by a separating operation by stripping rollers $317_1$ and $317_2$ at the third (3) step described above, since otherwise possible deformation of tubular film 301 then is prevented by shaping plates $306_1$ and $306_2$ and shutter plates $304_1$ and $304_2$, errors in the packaged amount of object substance A" for packaging actually found with a tubular film filled by a vertical type forming, filling and closing machine for a flexible package produced in accordance with the present embodiment were within 1% of a preset value.

Figure 6:
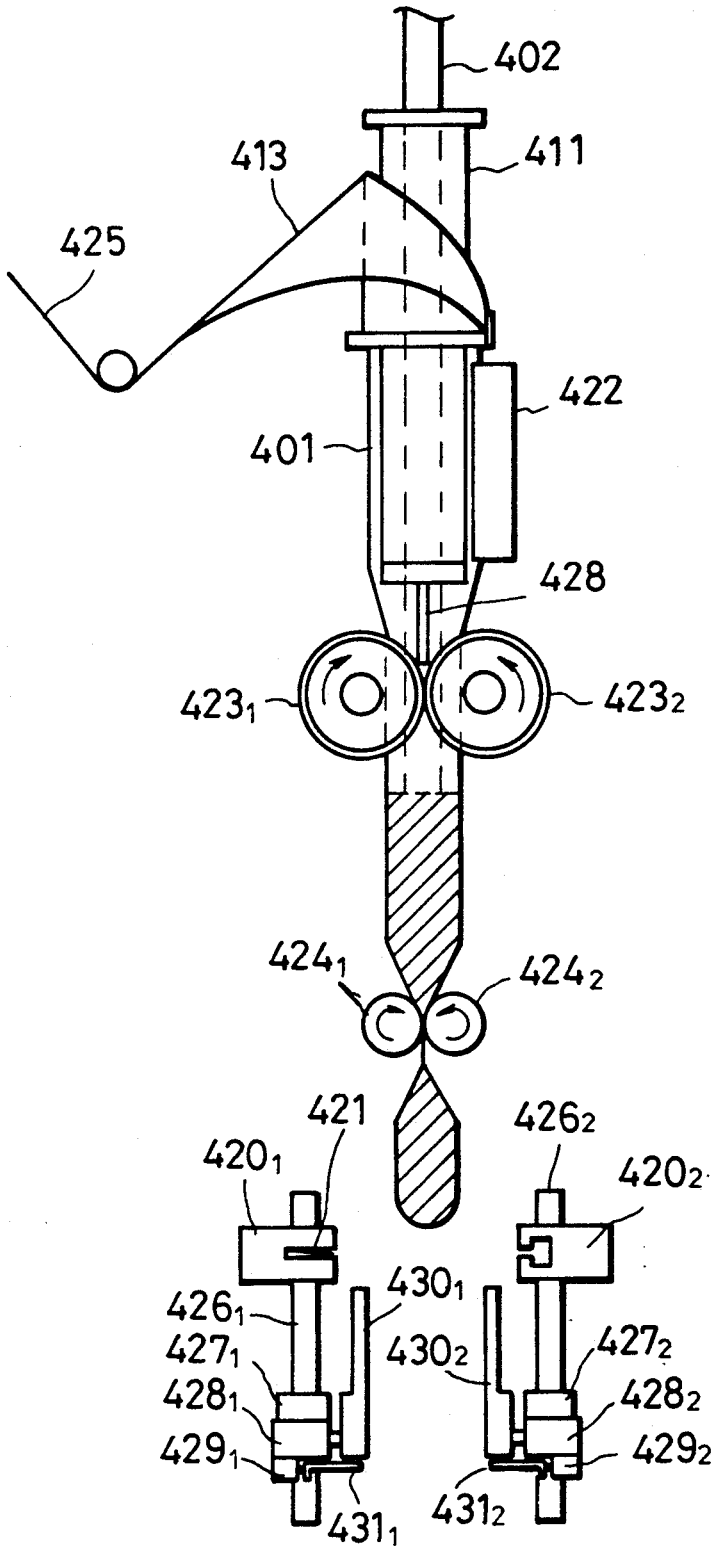
FIG. 6 is a side elevational view, partly in section, showing part of a vertical type forming, filling and closing machine for a flexible package according to a third preferred embodiment of the present invention.
Figure 7:
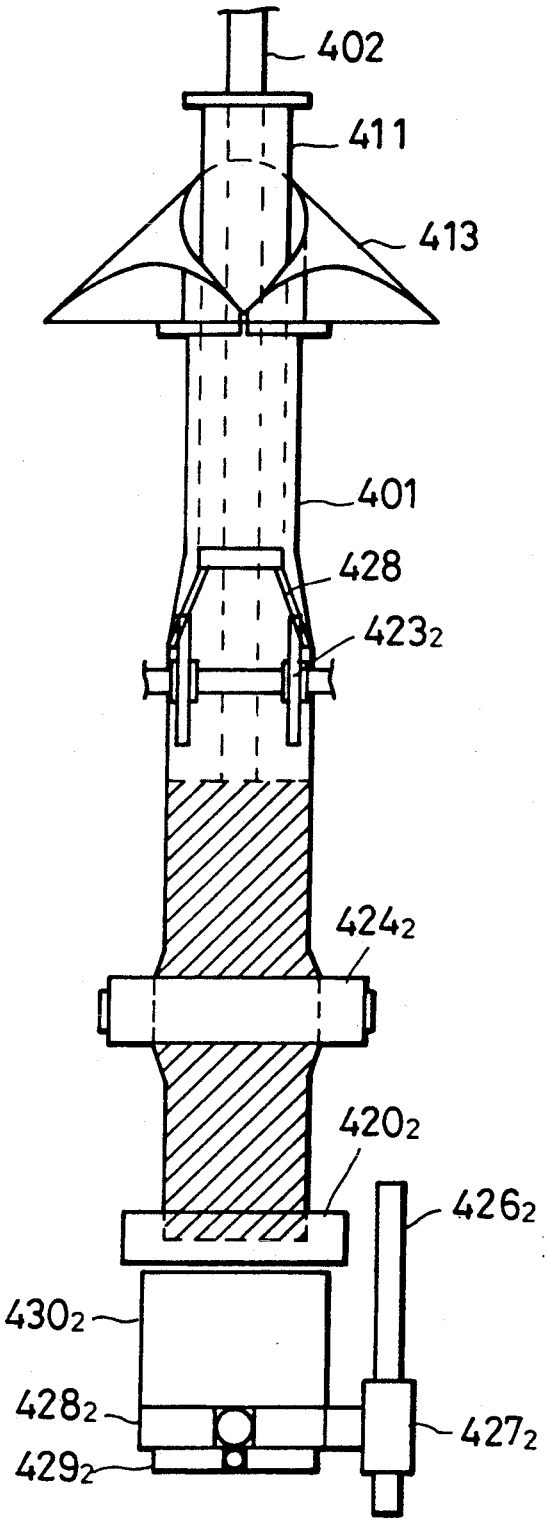
FIG. 7 is a front elevational view showing the vertical type forming, filling and closing machine for a flexible package of FIG. 6.

Referring now to FIGS. 6 and 7, there is shown a vertical type forming, filling and closing machine for a flexible package according to a third preferred embodiment of the present invention. The vertical type forming, filling and closing machine for a flexible package of the present embodiment is a modification of the vertical type forming, filling and closing machine for a flexible package of the preceding embodiment in that the shaping plates and shutter plates are constructed for movement in the longitudinal direction of the tubular film so that a package of a small size for the object substance can be produced.

If shaping plates are disposed between the injection nozzle and the horizontal sealing blades as in the vertical type forming, filling and closing machine for a flexible package of the second embodiment shown in FIG. 5, then the horizontal sealing blades which move to form the bag must necessarily be designed so that they not interfere with the shaping plates. This design makes the machine complicated. Further, while the bottom of the bag and the shutter plates are preferably positioned as close as possible, this arrangement is restricted where the shutter plates are fixed. Therefore, the vertical type forming, filling and closing machine for a flexible package of the present embodiment is so constructed that the shaping plates and the shutter plates are moved vertically downwardly when a horizontal sealing operation is to be performed.

Injection nozzle 402, injection pipe 411, bag forming guide 413, a pair of sealing blades $\mathbf{420_1}$ and $\mathbf{420_2}$, cutting blade 421, vertical sealing section 422, a pair of film feeding rollers $\mathbf{423_1}$ and $\mathbf{423_2}$ and a pair of stripping rollers $\mathbf{424_1}$ and $\mathbf{424_2}$ and guide stretching member 428 of the vertical type forming, filling and closing machine for a flexible package of the present embodiment are similar to injection nozzle 902, injection pipe 911, bag forming guide 913, sealing blades $\mathbf{920_1}$ and $\mathbf{920_2}$, cutting blade 921, vertical sealing section 922, film feeding rollers $\mathbf{923_1}$ and $\mathbf{923_2}$ and stripping rollers $\mathbf{924_1}$ and $\mathbf{924_2}$ and guide stretching member 928, respectively, of the conventional vertical type forming, filling and closing machine for a flexible package shown in FIG. 1. Also operation of the components is similar to that of the corresponding components. Further, tubular film 401 and sheet film 425 are similar to tubular film 901 and sheet film 925, respectively. Thus, overlapping descriptions will be omitted herein to avoid redundancy.

A pair of shaping plates $\mathbf{426_1}$ and $\mathbf{426_2}$ and a pair of shutter plates $\mathbf{431_1}$ and $\mathbf{431_2}$ are disposed for movement below stripping rollers $\mathbf{424_1}$ and $\mathbf{424_2}$. Shaping plates $\mathbf{426_1}$ and $\mathbf{426_2}$ and shutter plates $\mathbf{431_1}$ and $\mathbf{431_2}$ are moved by a pair of cylinders $\mathbf{426_1}$ and $\mathbf{426_2}$ and another pair of shutter plates $\mathbf{429_1}$ and $\mathbf{429_2}$, respectively, in the direction in which tubular film 401 is held between the plates in each pair. Cylinders $\mathbf{428_1}$ and $\mathbf{428_2}$ and cylinders $\mathbf{429_1}$ and $\mathbf{429_2}$ are connected to a pair of sliding members $\mathbf{427_1}$ and $\mathbf{427_2}$ which move in the longitudinal direction of tubular film 401 along a pair of support bars $\mathbf{426_1}$ and $\mathbf{426_2}$, respectively.

Shaping plates $\mathbf{426_1}$ and $\mathbf{426_2}$, shutter plates $\mathbf{431_1}$ and $\mathbf{431_2}$ and cylinders $\mathbf{428_1}$, $\mathbf{428_2}$ and $\mathbf{429_1}$, $\mathbf{429_2}$ for them are individually disposed in a symmetrical relationship with respect to the longitudinal direction of the tubular film 401.

Figure 8A:
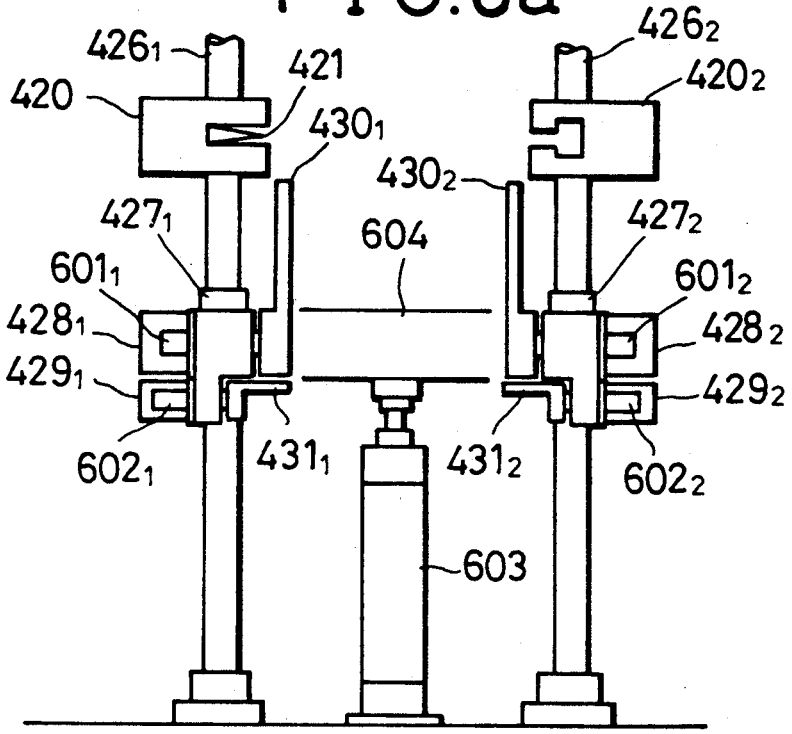
FIGS. 8*a* and 8*b* are front and side elevational views, respectively, of a molding plate and a moving mechanism for a shutter plate of the vertical type forming, filling and closing machine for a flexible package of FIG. 6.
Figure 8B:
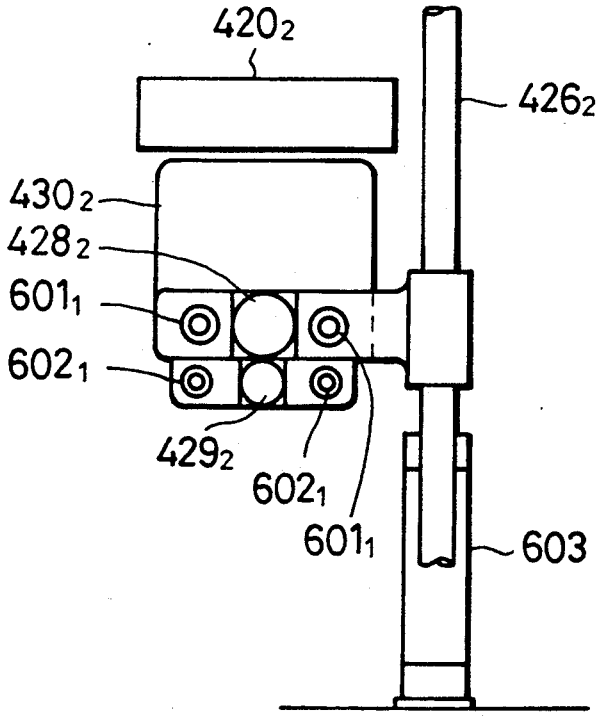

Referring now to FIGS. 8*a* and 8*b*, sliding members $\mathbf{427_1}$ and $\mathbf{427_2}$, which move along support bars $\mathbf{426_1}$ and $\mathbf{426_2}$, respectively, are connected to each other by connecting bar 604. Connecting bar 604 is moved upwardly or downwardly in the longitudinal direction of tubular film 401 by shaping plate vertically moving cylinder 603, and sliding members $\mathbf{427_1}$ and $\mathbf{427_2}$ and shaping plates $\mathbf{426_1}$ and $\mathbf{426_2}$ and shutter plates $\mathbf{431_1}$ and $\mathbf{431_2}$ provided in a juxtaposed relationship to sliding members $\mathbf{427_1}$ and $\mathbf{427_2}$ are moved upwardly or downwardly when connecting bar 604 is moved upwardly or downwardly.

A pair of shaping plate guides $\mathbf{601_1}$ and $\mathbf{601_2}$ and a pair of shutter plate guides $\mathbf{602_1}$ and $\mathbf{602_2}$ for supporting shaping plates $\mathbf{426_1}$ and $\mathbf{426_2}$ and shutter plates $\mathbf{431_1}$ and $\mathbf{431_2}$ in the moving directions, respectively, are provided on sliding members $\mathbf{427_1}$ and $\mathbf{427_2}$, respectively.

The filling operation of the vertical type forming, filling and closing machine for a flexible package of the present embodiment having the construction described above is controlled by a controlling apparatus (not shown). Different steps of this filling operation are schematically shown in FIGS. 9*a* to 9*j*.

Figures 9A, 9B, 9C, 9D, 9E:
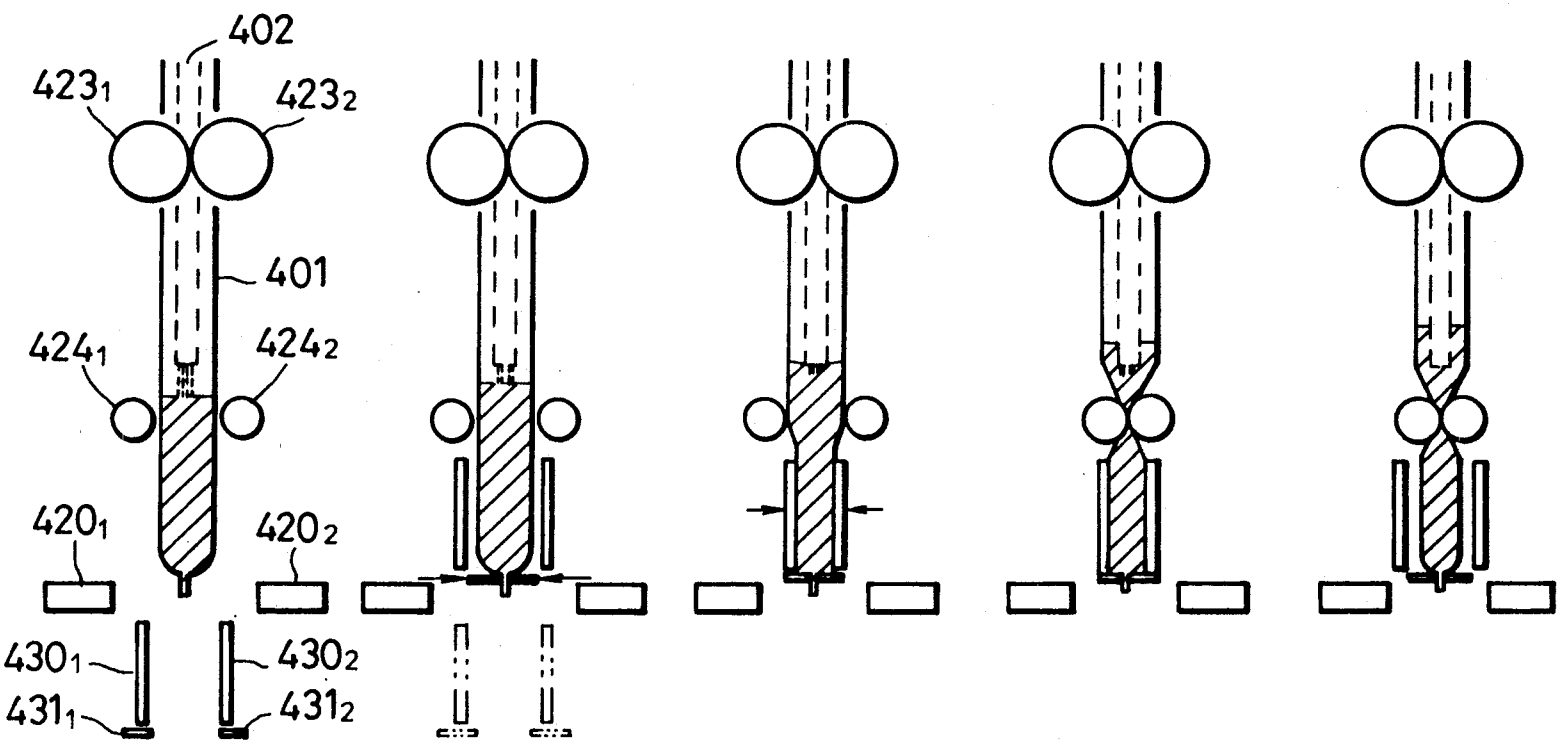
FIGS. 9*a* to 9*j* are illustrations schematically showing different steps of the filling operation of the vertical type forming, filling and closing machine for a flexible package of FIG. 6.

At the step of injecting the object substance illustrated in FIG. 9*a*, rotation of film feeding rollers $\mathbf{423_1}$ and $\mathbf{423_2}$ and stripping rollers $\mathbf{424_1}$ and $\mathbf{424_2}$ is stopped, and stripping rollers $\mathbf{424_1}$ and $\mathbf{424_2}$, horizontal sealing blades $\mathbf{420_1}$ and $\mathbf{420_2}$, shaping plates $\mathbf{426_1}$ and $\mathbf{426_2}$ and shutter plates $\mathbf{431_1}$ and $\mathbf{431_2}$ are individually spaced away from each other in the leftward and rightward direction. Further, shaping plates $\mathbf{426_1}$ and $\mathbf{426_2}$ and shutter plates $\mathbf{431_1}$ and $\mathbf{431_2}$ are positioned below horizontal sealing blades $\mathbf{420_1}$ and $\mathbf{420_2}$.

After completion of this injection of the object substance, shaping plates $\mathbf{426_1}$ and $\mathbf{426_2}$ and shutter plates $\mathbf{431_1}$ and $\mathbf{431_2}$ are moved upwardly by shaping plate vertically moving cylinder 603 (refer to FIG. 8) until they are positioned between stripping rollers $\mathbf{424_1}$ and $\mathbf{424_2}$ and horizontal sealing blades $\mathbf{420_1}$ and $\mathbf{420_2}$ as seen in FIG. 9*b*. Then, shutter plates $\mathbf{431_1}$ and $\mathbf{431_2}$ are moved by cylinders $\mathbf{429_1}$ and $\mathbf{429_2}$ (refer to FIG. 8), respectively, in the direction in which tubular film 401 is held between them until they support a portion of tubular film 401 which is to make the bottom portion of a bag.

Subsequently, shaping plates $\mathbf{426_1}$ and $\mathbf{426_2}$ are moved by cylinders $\mathbf{428_1}$ and $\mathbf{428_2}$ (refer to FIG. 8), respectively, in the direction in which tubular film 401 is held between them as shown in FIG. 9*c* until they support another portion of tubular film 401 which is to make the body portion of the bag.

After the operation of shaping plates $\mathbf{426_1}$ and $\mathbf{426_2}$ and shutter plates $\mathbf{431_1}$ and $\mathbf{431_2}$ to hold tubular film 401 which is to make the bag is completed, stripping rollers $\mathbf{424_1}$ and $\mathbf{424_2}$ are moved toward the center of tubular film 401 to a position at which the upper portion of the bag formed by tubular film 401 is closed as shown in FIG. 9*d*. The bag thereupon assumes a predetermined shape depending upon the positions of shaping plates $\mathbf{426_1}$ and $\mathbf{426_2}$, shutter plates $\mathbf{431_1}$ and $\mathbf{431_2}$ and stripping rollers $\mathbf{424_1}$ and $\mathbf{424_2}$, and consequently contains therein a fixed amount of the object substance for packaging therein.

Figures 9F, 9G, 9H, 9I, 9J:
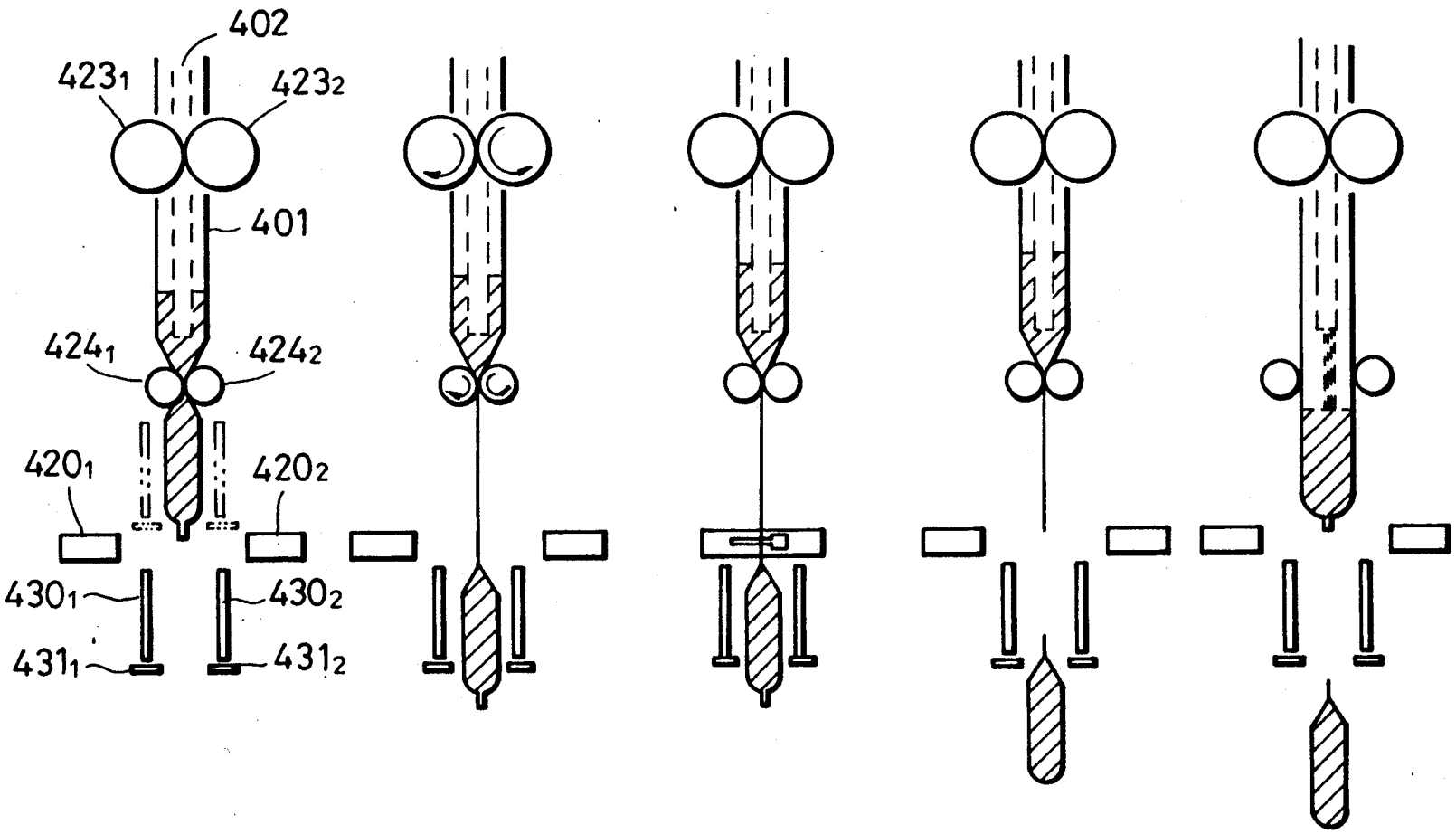

After completion of this movement of stripping rollers $\mathbf{424_1}$ and $\mathbf{424_2}$, shaping plates $\mathbf{426_1}$ and $\mathbf{426_2}$ are moved in a direction in which they are spaced away from tubular film 401 as shown in FIG. 9*e*, and then shutter plates $\mathbf{431_1}$ and $\mathbf{431_2}$ are moved in a direction in which they are spaced away from tubular film 401 as shown in FIG. 9*f*, whereafter shaping plates $\mathbf{426_1}$ and $\mathbf{426_2}$ and shutter plates $\mathbf{431_1}$ and $\mathbf{431_2}$ are moved downwardly below horizontal sealing blades $\mathbf{420_1}$ and $\mathbf{420_2}$.

Subsequently, film feeding rollers $\mathbf{418_1}$ and $\mathbf{418_2}$ and stripping rollers $\mathbf{424_1}$ and $\mathbf{424_2}$ are rotated to cause tubular film 401 to form an empty filling portion in which the object substance filled in tubular film 401 is separated as shown in FIG. 9*g*.

When the empty filling portion formed by this operation described just above comes to the position of horizontal sealing blades $\mathbf{420_1}$ and $\mathbf{420_2}$, horizontal sealing blades $\mathbf{420_1}$ and $\mathbf{420_2}$ are moved toward tubular film 401 as shown in FIG. 9*h* to perform horizontal sealing and a cutting operation of tubular film 401 as shown in FIG. 9*i*.

Then, injection of the object substance for packaging is performed by injection pipe 402 as shown in FIG. 9*j*.

Thereafter, the steps described above are successively repeated to package a predetermined amount of the object substance for packaging.

In the vertical type forming, filling and closing machine for a flexible package of the present embodiment, since shaping plates $426_1$ and $426_2$ and shutter plates $431_1$ and $431_2$ are movable in the direction in which tubular film 401 is moved to form a bag, the position of the bag at which the bag is held by shutter plates $431_1$ and $431_2$ is defined as the bottom of the bag, which further reduces errors in the packaged amount. In addition, the degree of freedom in designing stripping rollers $424_1$ and $424_2$ and horizontal sealing blades $420_1$ and $420_2$ is enhanced.

With the vertical type forming, filling and closing machines for a flexible package of the embodiments described above, while no particular description is given of the injection nozzle in the description of the vertical type forming, filling and closing machines for a flexible package of the second and third embodiments which include the shaping plates and shutter plates, the advantage arising from provision of the shaping plates and shutter plates is independent of any advantage arising from the construction of the injection nozzle as in the vertical type forming, filling and closing machine for a flexible package of the first embodiment. As a result, the two constructions may be employed in combination to attain the two advantages.

With the vertical type forming, filling and closing machines for a flexible package manufactured in accordance with the present invention in which the injection nozzle was constructed for movement, since the injection discharging opening of the injection nozzle was always buried by a predetermined level from the upper surface of the injected object substance for packaging, the amounts of the object substance packaged in tubular films were fixed and errors in the packaged amounts were always small.

With the other vertical type forming, filling and closing machines in which shaping plates and shutter plates for preventing deformation of the bag during the filling operation were provided, bags formed thereon were the same in profile and the amounts of the object substance packed in tubular films were fixed, and errors in the packaged error amounts were small as well.

With the vertical type forming, filling and closing machine in which the shaping plates were constructed for movement in the direction in which the bag was formed, the degree of freedom in designing was enhanced in addition to the advantages described above.

With the vertical type forming, filling and closing machine in which the shutter plates were constructed for movement in the direction in which the bag was formed, since the shutter plates were moved to hold the bottom of the bag at the optimum position, errors in the packaged amounts were further reduced.

In addition, if the movable injection nozzle and the shaping plates and shutter plates are provided in combination, then errors in the packaged amounts will be further reduced due to multiplication of the advantages described above.

What is claimed is:

1. A vertical type forming, filling and closing machine for a flexible bag for filling a fluid substance discharged from an injection nozzle to a predetermined height into a bag and packaging the same, comprising:

an injection nozzle having a discharging opening for filling a bag with a fluid substance;

upper surface height detecting means for detecting the height of the upper surface of the fluid substance filled in the bag;

a cylinder connected to said injection nozzle for moving said injection nozzle upwardly and downwardly; and a controlling apparatus for controlling said cylinder in response to the result of detection of said upper surface height detecting means to move said injection nozzle upwardly or downwardly during filling;

said controlling apparatus controlling said cylinder so that the discharging opening of said injection nozzle is always buried, during filling, to a predetermined level from the upper surface of the fluid substance filled in the bag.

2. A vertical forming, filling and closing machine for forming flexible packages with a flexible packing material comprising:

a nozzle for filling the flexible package with contents;

a height detector for detecting a height of said contents supplied by said filling nozzle during a filing operation, and thereby controlling the filling operation;

deformation preventing means for preventing deformation of the flexible package, said deformation preventing means including means for holding bottom and side portions of the flexible package during filling and height sensing, thereby preventing deformation of said flexible package and increasing the accuracy of said height detecting performed by said height detector.

3. The forming, filling and closing machine of claim 2, wherein said deformation preventing means do not restrict an upper vertical height of said flexible package.

4. The forming, filling and closing machine of claim 2, further including means for vertically moving said deformation preventing means.

5. A forming, filling and closing machine comprising:

a nozzle for introducing contents into a bag;

at least one of a shaping plate and a shutter plate to restrain movement of respective body and bottom portions of a bag during filling;

sealing blades for forming a seal in a bag after filling; and means for vertically moving said at least one of a shaping plate and a shutter plate such that during filling said at least one of a shaping plate and a shutter plate is located above said sealing blades, and during sealing by said sealing plates, said at least one of a shaping plate and a shutter plate is located below said sealing blades.

6. The vertical forming filling and closing machine of claim 5, including each of a shaping plate and a shutter plate, and wherein said means for vertically moving moves each of said shaping plate and shutter plate;

the machine further including an upper surface height detector for detecting the height of contents in the flexible package.

7. The vertical forming filling and closing machine of claims 2 or 6, further including:

a cylinder connected to the nozzle for moving the nozzle upwardly and downwardly; and a controlling apparatus for controlling said cylinder in response outputs from the height detector corresponding to a detected height of said contents, such that said controlling apparatus causes said cylinder to move at least one of said shaping plate and said shutter plate upwardly and downwardly in response to a detected height, and such that said nozzle is maintained at a predetermined level from the upper surface of the contents during filling.

* * * * *

UNITED STATES PATENT AND TRADEMARK OFFICE

CERTIFICATE OF CORRECTION

PATENT NO. : 5,241,804
DATED : September 7, 1993
INVENTOR(S) : Orihiro Tsuruta, et. al.

It is certified that error appears in the above-indentified patent and that said Letters Patent is hereby corrected as shown below:

Title page, item [30], Priority Data, change the third priority data from "3-049390" to --4-049390--.

Signed and Sealed this

Fifth Day of April, 1994

Bruce Lehman

*Attest:*

BRUCE LEHMAN

*Attesting Officer*

*Commissioner of Patents and Trademarks*